US009842599B2

(12) United States Patent
Matsumoto

(10) Patent No.: US 9,842,599 B2
(45) Date of Patent: Dec. 12, 2017

(54) VOICE PROCESSING APPARATUS AND VOICE PROCESSING METHOD

(71) Applicant: FUJITSU LIMITED, Kawasaki-shi, Kanagawa (JP)

(72) Inventor: Chikako Matsumoto, Yokohama (JP)

(73) Assignee: FUJITSU LIMITED, Kawasaki (JP)

( * ) Notice: Subject to any disclaimer, the term of this patent is extended or adjusted under 35 U.S.C. 154(b) by 189 days.

(21) Appl. No.: 14/469,681

(22) Filed: Aug. 27, 2014

(65) Prior Publication Data

US 2015/0088494 A1 Mar. 26, 2015

(30) Foreign Application Priority Data

Sep. 20, 2013 (JP) ..... 2013-196118

(51) Int. Cl.
*G10L 21/0208* (2013.01)
*G10L 25/84* (2013.01)
(Continued)

(52) U.S. Cl.
CPC ..... *G10L 19/02* (2013.01); *G10L 21/00* (2013.01); *G10L 21/0208* (2013.01);
(Continued)

(58) Field of Classification Search
CPC ..... G10L 21/0208; G10L 25/84; G10L 2025/786; H04R 3/005
See application file for complete search history.

(56) References Cited

U.S. PATENT DOCUMENTS

2007/0110258 A1* 5/2007 Kimijima ..... H04S 7/30 381/97
2007/0274536 A1 11/2007 Matsuo
(Continued)

FOREIGN PATENT DOCUMENTS

JP 2001-100800 4/2001
JP 2002-095084 3/2002
(Continued)

OTHER PUBLICATIONS

EESR—Extended European Search Report of European Patent Application No. 14182463.1 dated Feb. 25, 2015.

*Primary Examiner* — Paras D Shah
*Assistant Examiner* — Bryan Blankenagel
(74) *Attorney, Agent, or Firm* — Fujitsu Patent Center

(57) ABSTRACT

A voice processing apparatus calculates a phase difference between first and second frequency signals obtained by transforming first and second voice signals generated by two voice input units for each frequency, calculates, for each extension range set outside or inside a reference range, a presence ratio based on the number of frequencies with the phase difference between the first and second frequency signals falling within the extension range, the reference range representing a range of the phase difference between the first and second voice signals for each frequency and corresponding to a direction in which a target sound source is assumed to be located, and sets, as a non-suppression range, a first extension range having the presence ratio higher than a predetermined value and a second extension range closer to the phase difference at the center of the reference range than the first extension range is within the reference range.

10 Claims, 10 Drawing Sheets

(51) Int. Cl.

| | |
|---|---|
| ***G10L 25/78*** | (2013.01) |
| ***H04R 3/00*** | (2006.01) |
| ***G10L 19/02*** | (2013.01) |
| ***G10L 21/0232*** | (2013.01) |
| ***G10L 21/00*** | (2013.01) |
| *G10L 21/0216* | (2013.01) |

(52) U.S. Cl.

CPC ..... *G10L 21/0232* (2013.01); *G10L 25/84* (2013.01); *H04R 3/005* (2013.01); *G10L 2021/02166* (2013.01); *G10L 2021/02168* (2013.01); *G10L 2025/786* (2013.01)

(56) References Cited

U.S. PATENT DOCUMENTS

2008/0219471 A1* 9/2008 Sugiyama ..... G10L 21/0208 381/94.2
2009/0129610 A1* 5/2009 Kim ..... G10K 11/178 381/94.7
2009/0285409 A1* 11/2009 Yoshizawa ..... G01S 3/8083 381/92
2010/0128896 A1* 5/2010 Hayakawa ..... H04R 3/005 381/92
2010/0232620 A1* 9/2010 Matsuo ..... H04S 7/30 381/92
2010/0322437 A1* 12/2010 Matsuo ..... G10L 21/0208 381/94.2
2011/0158426 A1* 6/2011 Matsuo ..... H04R 3/005 381/92
2011/0235822 A1* 9/2011 Jeong ..... H04R 3/005 381/92
2012/0057712 A1* 3/2012 Deschamp ..... H04S 7/40 381/58
2012/0130713 A1* 5/2012 Shin ..... G10L 25/78 704/233
2012/0148069 A1* 6/2012 Bai ..... H04R 1/1083 381/94.1
2012/0162471 A1* 6/2012 Sekiya ..... G10L 21/0208 348/231.4
2012/0179458 A1* 7/2012 Oh ..... G10L 21/0208 704/203
2013/0058488 A1* 3/2013 Cheng ..... G10L 25/81 381/56
2013/0109372 A1* 5/2013 Ekici ..... H04W 24/02 455/422.1
2013/0166286 A1* 6/2013 Matsumoto ..... G10L 21/02 704/205

FOREIGN PATENT DOCUMENTS

| | | |
|---|---|---|
| JP | 2003-337164 | 11/2003 |
| JP | 2007-318528 | 12/2007 |
| JP | 2010-176105 | 8/2010 |
| JP | 2011-165056 | 8/2011 |

* cited by examiner

| n | dn | Δdn |
|---|---|---|
| 1 | 2.66 | 1.31 |
| 2 | 1.34 | 0.78 |
| 3 | 0.56 | 0.48 |
| 4 | 0.08 | |

300

| n | dn | Δdn |
|---|---|---|
| 1 | 0.08 | 0.48 |
| 2 | 0.56 | 0.78 |
| 3 | 1.34 | 1.32 |
| 4 | 2.66 | |

400

VOICE PROCESSING APPARATUS AND VOICE PROCESSING METHOD

CROSS-REFERENCE TO RELATED APPLICATION

This application is based upon and claims the benefit of priority of the prior Japanese Patent Application No. 2013-196118, filed on Sep. 20, 2013, and the entire contents of which are incorporated herein by reference.

FIELD

The embodiments discussed herein are related to a voice processing apparatus and a voice processing method for recorded voices by using a plurality of microphones.

BACKGROUND

Recent years have seen the development of voice processing apparatuses, such as mobile phones, teleconferencing systems, and telephones equipped with hands-free talking capability, that record voices by using a plurality of microphones. For such voice processing apparatuses, developing technologies for the voices recorded, attenuating voice coming from any direction other than a specific direction and thereby making voice coming from the specific direction easier to hear has been proceeding (refer to Japanese Laid-open Patent Publication No. 2007-318528 and Japanese Laid-open Patent Publication No. 2010-176105, for example).

For example, Japanese Laid-open Patent Publication No. 2007-318528 discloses a directional sound recording device which converts a sound received from each of a plurality of sound sources, each located in a different direction, into a frequency-domain signal, calculates a suppression coefficient for suppressing the frequency-domain signal, and corrects the frequency-domain signal by multiplying the amplitude component of the frequency-domain signal of the original signal by the suppression coefficient. The directional sound recording device calculates the phase components of the respective frequency-domain signals on a frequency-by-frequency basis, calculates the difference between the phase components, and determines, based on the difference, a probability value which indicates the probability that a sound source is located in a particular direction. Then, the directional sound recording device calculates, based on the probability value, a suppression coefficient for suppressing the sound arriving from any sound source other than the sound source located in the particular direction.

On the other hand, Japanese Laid-open Patent Publication No. 2010-176105 discloses a noise suppressing device which isolates sound sources of sounds received by two or more microphones and estimates the direction of the sound source of the target sound from among the isolated sound sources. Then, the noise suppressing device detects the phase difference between the microphones by using the direction of the sound source of the target sound, updates the center value of the phase difference by using the detected phase difference, and suppresses noise received by the microphones by using a noise suppressing filter generated using the updated center value.

SUMMARY

However, when recorded voice signals have a low signal to noise ratio (SNR), it is difficult to isolate the target sound and noise from the voice signals. Accordingly, when the SNR is low, the probability that the sound source is located in a particular direction is not calculated accurately, or the center value of the phase difference is not updated. As a result, the direction of the sound source may not be estimated accurately. Therefore, in any of the above background art, the sound desired to be enhanced may be mistakenly suppressed or conversely, the sound desired to be suppressed may not be suppressed, which may distort a resultant voice signal.

According to one embodiment, a voice processing apparatus is provided. The voice processing apparatus includes: a first voice input unit which generates a first voice signal representing a recorded voice; a second voice input unit which is provided at a position different from the position of the first voice input unit, and which generates a second voice signal representing a recorded voice; a storage unit which stores a reference range representing a range of a phase difference between the first voice signal and the second voice signal for each frequency and corresponding to a direction in which a target sound source desired to be recorded is assumed to be located, and at least one extension range representing a range of a phase difference between the first voice signal and the second voice signal for each frequency and set outside or inside the reference range so as to align in order from one edge of the reference range; a time-frequency transforming unit which transforms the first voice signal and the second voice signal respectively into a first frequency signal and a second frequency signal in a frequency domain, on a frame-by-frame basis with each frame having a predetermined time length; a phase difference calculation unit which calculates a phase difference between the first frequency signal and the second frequency signal for each of a plurality of frequencies on the frame-by-frame basis; a presence-ratio calculation unit which calculates, for each of the at least one extension range, a presence ratio corresponding to ratio of number of frequencies each with the phase difference between the first frequency signal and the second frequency signal falling within the extension range to total number of frequencies included in a frequency band in which the first frequency signal and the second frequency signal are calculated, on the frame-by-frame basis; a non-suppression range setting unit which sets, as a non-suppression range, a first extension range having the presence ratio higher than a predetermined value and a second extension range closer to the phase difference at center of the reference range than the first extension range is, among the at least one extension range, and a range not including a third extension range farther from the phase difference at the center of the reference range than the first extension range is, in the reference range, and which sets, as a suppression range, a range of the phase difference outside the non-suppression range on the frame-by-frame basis; a suppression coefficient calculation unit which calculates, for at least one of the first and second frequency signals, a suppression coefficient for attenuating a frequency component having phase difference between the first frequency signal and the second frequency signal falling within the suppression range, at a greater extent than attenuation for a frequency component having the phase difference between the first frequency signal and the second frequency signal falling within the non-suppression range, on the frame-by-frame basis; a signal correction unit which corrects at least one of the first and second frequency signals by multiplying amplitude of the component of the at least one of the first and second frequency signals at each frequency by the suppression coefficient for the frequency on the frame-by-frame basis; and a frequency-time transforming unit which transforms the at least one of the first and second frequency signals corrected into a corrected voice signal in a time domain.

The object and advantages of the invention will be realized and attained by means of the elements and combinations particularly indicated in the claims.

It is to be understood that both the foregoing general description and the following detailed description are exemplary and explanatory and are not restrictive of the invention, as claimed.

DESCRIPTION OF EMBODIMENTS

Various embodiments of a voice processing apparatus will be described below with reference to the drawings. The voice processing apparatus obtains for each of a plurality of frequencies the phase difference between the voice signals recorded by a plurality of voice input units. Then, the voice processing apparatus attenuates, as noise, components of the voice signals, the components being at the frequencies each with a phase difference not falling within a reference range, which is the range of the phase difference corresponding to the direction in which the sound source of the target sound is assumed to be located. In addition, when the ratio of the number of frequencies each with a phase difference falling within an extension range, which is adjacent to the reference range, to the total number is higher than or equal to a certain value, the voice processing apparatus determines that the frequency components of the signals in the extension range are not to be attenuated. In this way, the voice processing apparatus suppresses distortion of voice due to noise suppression by reducing the possibility of the target sound being attenuated, even when the SNR of the target sound is low and the direction from which the target sound comes is not possible to be estimated accurately.

Figure 1:
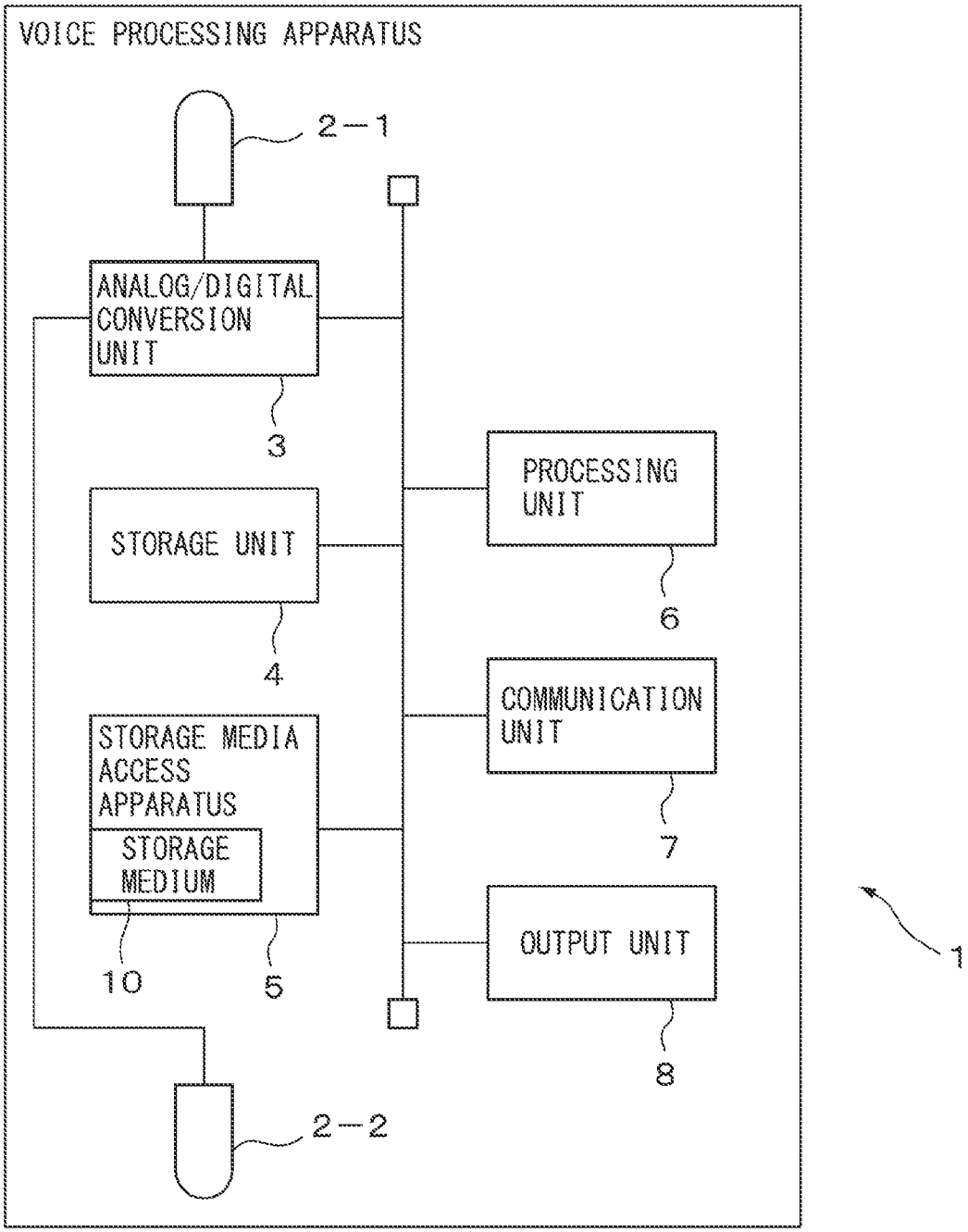
FIG. 1 is a diagram schematically illustrating the configuration of a voice processing apparatus.

FIG. 1 is a diagram schematically illustrating the configuration of a voice processing apparatus according to one embodiment. The voice processing apparatus 1 is, for example, a mobile phone, and includes voice input units 2-1 and 2-2, an analog/digital conversion unit 3, a storage unit 4, a storage media access apparatus 5, a processing unit 6, a communication unit 7, and an output unit 8.

The voice input units 2-1 and 2-2, each equipped, for example, with a microphone, record voice from the surroundings of the voice input units 2-1 and 2-2, generate analog voice signals proportional to the sound level of the recorded voice, and supply the analog voice signals to the analog/digital conversion unit 3. The voice input units 2-1 and 2-2 are, for example, spaced a predetermined distance (e.g., approximately several centimeters) away from each other so that the voice arrives at the respective voice input units at different times according to the location of the sound source. For example, the voice input unit 2-1 is provided near one end portion, in the longitudinal direction, of the housing of a mobile phone, while the voice input unit 2-2 is provided near the other end portion, in the longitudinal direction, of the housing. As a result, the phase difference between the voice signals recorded by the respective voice input units 2-1 and 2-2 varies according to the direction of the sound source. The voice processing apparatus 1 can therefore estimate the direction of the sound source by examining this phase difference.

The analog/digital conversion unit 3 includes, for example, an amplifier and an analog/digital converter. The analog/digital conversion unit 3, using the amplifier, amplifies the analog voice signals received from the respective voice input units 2-1 and 2-2. Then, each amplified analog voice signal is sampled at predetermined intervals of time (for example, 8 kHz) by the analog/digital converter in the analog/digital conversion unit 3, thus generating a digital voice signal. For convenience, the digital voice signal generated by converting the analog voice signal received from the voice input unit 2-1 will hereinafter be referred to as the first voice signal, and likewise, the digital voice signal generated by converting the analog voice signal received from the voice input unit 2-2 will hereinafter be referred to as the second voice signal. The analog/digital conversion unit 3 passes the first and second voice signals to the processing unit 6.

The storage unit 4 includes, for example, a read-write semiconductor memory and a read-only semiconductor memory. The storage unit 4 stores various kinds of computer programs and various kinds of data to be used by the voice processing apparatus 1.

The storage unit 4 also stores information indicating a reference range, which is a range of the phase difference between the first voice signal and the second voice signal for each frequency. The storage unit 4 further stores information indicating at least one extension range, which is a range of the phase difference between the first voice signal and the second voice signal for each frequency and is set to align in order from one edge of the reference range. Each of the information indicating the reference range and the information indicating each extension range includes, for example, the phase differences for each frequency at the respective edges of the corresponding one of the reference range and the extension range. Alternatively, each of the information indicating the reference range and the information indicating each extension range may include, for example, the phase difference for each frequency at the center of the corresponding one of the reference range and the extension range, and a width of the difference between the phase differences for each frequency of the corresponding one of the reference range and the extension range. The reference range and the extension ranges will be described later in detail.

The storage media access apparatus 5 is an apparatus for accessing a storage medium 10 which is, for example, a semiconductor memory card. The storage media access apparatus 5 reads the storage medium 10 to load a computer program to be execute on the processing unit 6 and passes the computer program to the processing unit 6.

The processing unit 6 includes one or a plurality of processors, a memory circuit, and their peripheral circuitry. The processing unit 6 controls the entire operation of the voice processing apparatus 1. When, for example, a telephone call is started by a user operating an operation unit such as a touch panel (not depicted) included in the voice processing apparatus 1, the processing unit 6 performs call control processing, such as call initiation, call answering, and call clearing.

The processing unit 6 corrects the first and second voice signals by attenuating noise or sound other than the target sound desired to be recorded, the noise or sound contained in the first and second voice signals, and thereby makes the target sound easier to hear. Then, the processing unit 6 encodes the first and second voice signals thus corrected, and outputs the encoded first and second voice signals via the communication unit 7. In addition, the processing unit 6 decodes encoded voice signal received from other apparatus via the communication unit 7, and outputs the decoded voice signal to the output unit 8.

In this embodiment, the target sound is voice of a user talking by using the voice processing apparatus 1, and the target sound source is the mouth of the user, for example. The voice processing by the processing unit 6 will be described later in detail.

The communication unit 7 transmits the first and second voice signals corrected by the processing unit 6 to other apparatus. For this purpose, the communication unit 7 includes, for example, a radio processing unit and an antenna. The radio processing unit of the communication unit 7 superimposes an uplink signal including the voice signals encoded by the processing unit 6, on a carrier wave having radio frequencies. Then, the uplink signal is transmitted to the other apparatus via the antenna. Further, the communication unit 7 may receive a downlink signal including a voice signal from the other apparatus. In this case, the communication unit 7 may pass the received downlink signal to the processing unit 6.

The output unit 8 includes, for example, a digital/analog converter for converting the voice signal received from the processing unit 6 into analog signals, and a speaker, and thereby reproduces the voice signal received from the processing unit 6.

Figure 2:
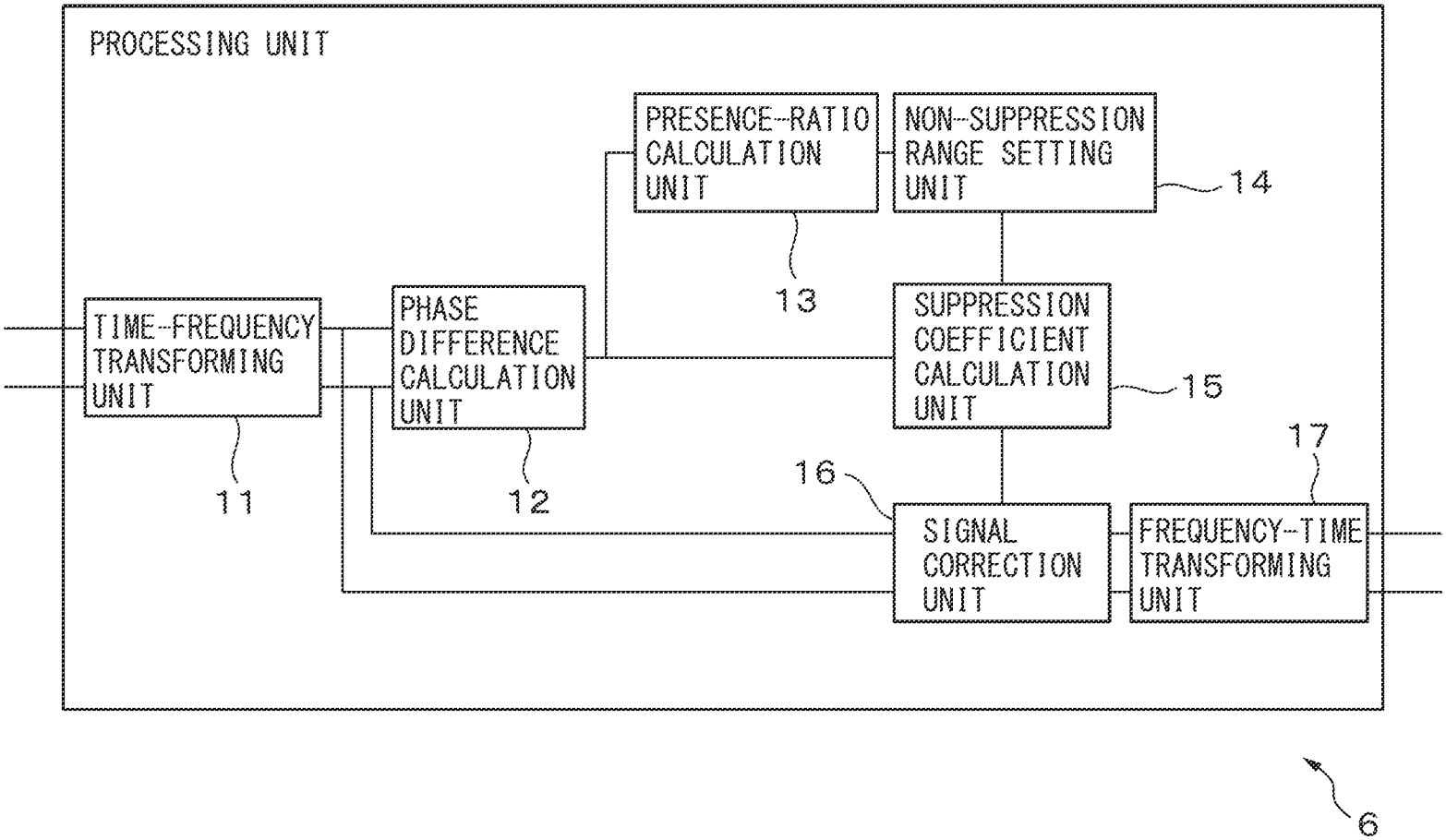
FIG. 2 is a diagram schematically illustrating the configuration of a processing unit.

The details of the voice processing by the processing unit 6 will be described below. FIG. 2 is a diagram schematically illustrating the configuration of the processing unit 6. The processing unit 6 includes a time-frequency transforming unit 11, a phase difference calculation unit 12, a presence-ratio calculation unit 13, a non-suppression range setting unit 14, a suppression coefficient calculation unit 15, a signal correction unit 16, and a frequency-time transforming unit 17. These units constituting the processing unit 6 may each be implemented, for example, as a functional module by a computer program executed on the processor incorporated in the processing unit 6. Alternatively, these units constituting the processing unit 6 may be implemented in the form of a single integrated circuit that implements the functions of the respective units on the voice processing apparatus 1, separately from the processor incorporated in the processing unit 6.

The time-frequency transforming unit 11 divides the first voice signal into frames each having a predefined time length (e.g., several tens of milliseconds), performs time frequency transformation on the first voice signal on a frame-by-frame basis, and thereby calculates the first frequency signals in the frequency domain. Similarly, the time-frequency transforming unit 11 divides the second voice signal into frames, performs time frequency transformation on the second voice signal on a frame-by-frame basis, and thereby calculates the second frequency signals in the frequency domain. The time-frequency transforming unit 11 may use, for example, a fast Fourier transform (FFT) or a modified discrete cosine transform (MDCT) for the time frequency transformation. Each of the first and second frequency signals contains frequency components the number of which is half the total number of sampling points included in the corresponding frame. The time-frequency transforming unit 11 supplies the first and second frequency signals to the phase difference calculation unit 12 and the signal correction unit 16 on a frame-by-frame basis.

The phase difference calculation unit 12 calculates the phase difference between the first and second frequency signals for each frequency on a frame-by-frame basis. The phase difference calculation unit 12 calculates the phase difference $\Delta\theta_f$ for each frequency, for example, in accordance with the following equation.

$$\Delta\theta_f = \tan^{-1}\left(\frac{S_{1f}}{S_{2f}}\right) \quad 0 < f < fs/2 \tag{1}$$

where $S_{1f}$ represents the component of the first frequency signal in a given frequency f, and $S_{2f}$ represents the component of the second frequency signal in the same frequency f. On the other hand, fs represents the sampling frequency. The phase difference calculation unit 12 passes the phase difference $\Delta\theta_f$ calculated for each frequency to the presence-ratio calculation unit 13 and the signal correction unit 16.

The presence-ratio calculation unit 13 calculates, for each extension range, the ratio of the number of frequencies each with the phase difference $\Delta\theta_f$ to the total number of frequencies included in the frequency band in which the first and second frequency signals are calculated, as the presence-ratio for the extension range on a frame-by-frame basis.

Description will be given of the reference range and extension ranges below. The reference range is a range of the phase difference between the first voice signal and the second voice signal for each frequency, and corresponds to the direction in which the target sound source is assumed to be located. The reference range is set in advance, for example, on the basis of an assumable standard way of holding the voice processing apparatus 1 and the positions of the voice input units 2-1 and 2-2. Meanwhile, each extension range is a range of the phase difference corresponding to the direction from which the target sound may possibly arrive depending on how the user holds the voice processing apparatus 1, the direction having a lower possibility that the direction corresponding to the extension range is the one from which the target sound arrives, than that for the reference range.

Figure 3:
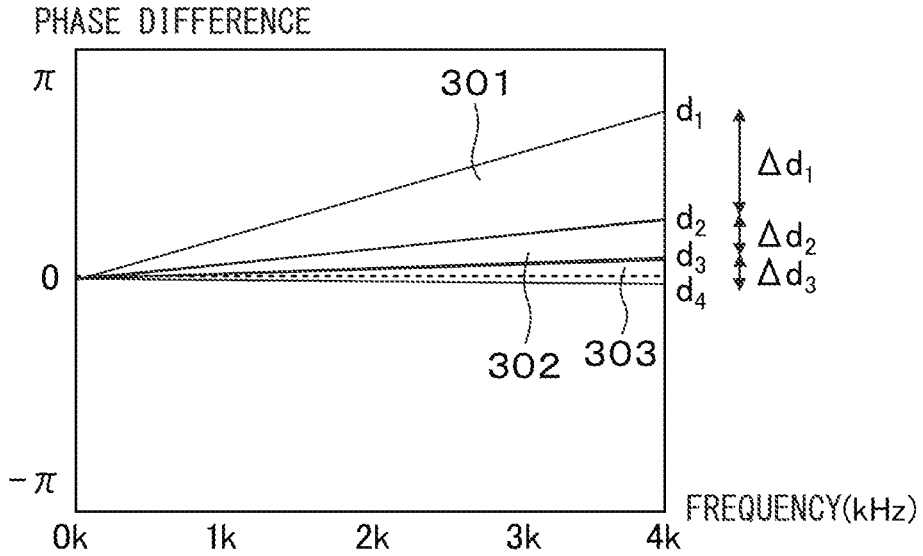
FIG. 3 is a graph and a table illustrating one example of a reference range and extension ranges.

FIG. 3 is a graph and a table illustrating an example of the reference range and the extension ranges. In FIG. 3, the abscissa represents the frequency, and the ordinate represents the phase difference. In this example, two extension ranges 302 and 303 are set to each include smaller phase differences than those in a reference range 301. The extension range 302 is adjacent to one edge of the reference range 301, the one edge representing the smallest phase difference in the reference range 301, and the extension range 303 is adjacent to one edge of the extension range 302, the one edge representing the smallest phase difference in the extension range 302. In this example, the extension range including smaller phase differences has a smaller width of the difference between the phase differences in the extension range. This is because, a smaller phase difference indicates that the sound source is located near a position equally away from the voice input unit 2-1 and the voice input unit 2-2, which improves the accuracy in estimating the direction of the sound source. Table 300 depicted in FIG. 3 presents the largest phase difference $d_n$ (n=1 to 4) of each of the reference range and the extension ranges at 4 kHz, and the difference $\Delta d_n$ (n=1 to 3) between the largest and smallest phase differences in each of the reference range and the extension ranges at 4 kHz. In this example, it is assumed that the first and second voice signals are generated by sampling analog voice signals generated by the respective first and second voice input units 2-1 and 2-2 at a sampling frequency of 8 kHz. In addition, it is assumed that the distance between the first voice input unit 2-1 and the second voice input unit 2-2 is smaller than (sound speed/sampling frequency). In this example, the reference range and the extension ranges are set so that the following relationship would be established between each of the largest and smallest phase differences $d_n$ and $d_{n+1}$ in each of the reference range and extension ranges and the difference $\Delta d_n$ between the largest and smallest phase differences, for components of the first and second frequency signals at the highest frequency (4 kHz).

$$\Delta d_n = 0.4 \times |d_n| + 0.25 \quad (2)$$

Figure 4:
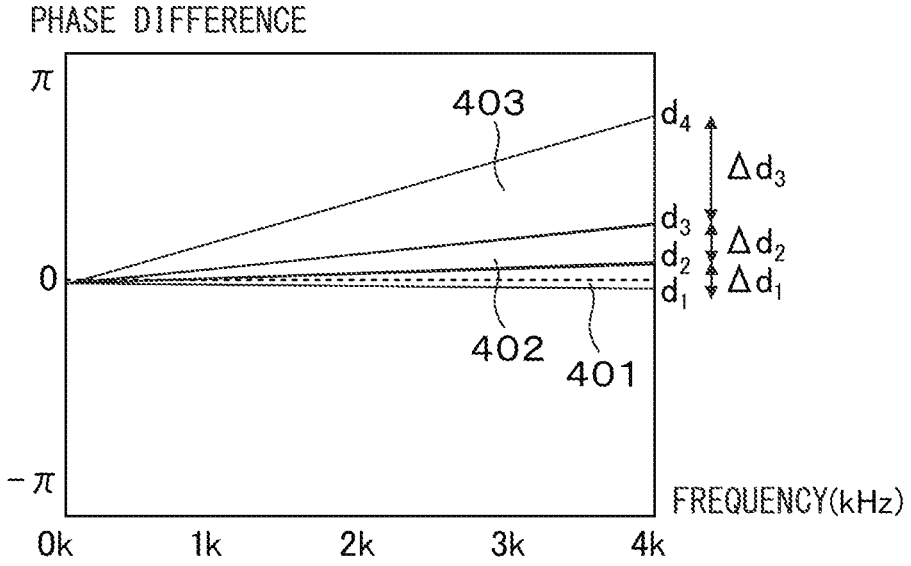
FIG. 4 is a graph and a table illustrating another example of the reference range and the extension ranges.

FIG. 4 is a graph and a table illustrating another example of the reference range and the extension ranges. In FIG. 4, the abscissa represents the frequency, and the ordinate represents the phase difference. In this example, two extension ranges 402 and 403 are set to each include larger phase differences than those in a reference range 401. The extension range 402 is adjacent to one edge of the reference range 401, the one edge representing the largest phase difference in the reference range 401, and the extension range 403 is adjacent to one edge of the extension range 402, the one edge representing the largest phase difference in the extension range 402. The extension range including smaller phase differences is set to be smaller also in this example. Table 400 depicted in FIG. 4 presents the largest phase difference $d_n$ (n=1 to 4) of each of the reference range and the extension ranges at 4 kHz, and the difference $\Delta d_n$ (n=1 to 3) between the largest and smallest phase differences in each of the reference range and the extension ranges at 4 kHz. In this example, the reference range and extension ranges are set so that the following relationship would be established between each of the largest and smallest phase differences $d_n$ and $d_{n+1}$ in each of the reference range and the extension ranges and the difference $\Delta d_n$ between the largest and smallest phase differences.

$$\Delta d_n = 0.6 \times |d_{n+1}| - 0.25 \quad (3)$$

Although the extension ranges are set only on one side of the reference range in the above examples, the extension ranges may be set on both sides of the reference range. Moreover, the number of extension ranges set on one side of the reference range, the one side having larger phase differences than those in the reference range, may be different from that of extension ranges set on the other side of the reference range, the other side having smaller phase differences than those in the reference range.

The presence-ratio calculation unit 13 loads information indicating the reference range and extension ranges from the storage unit 4. Then, the presence-ratio calculation unit 13 counts, for each extension range, the number of frequencies each with a phase difference falling within the extension range, on a frame-by-frame basis. Thereby, the presence-ratio calculation unit 13 calculates, for each extension range, a presence ratio which is the ratio of the number of frequencies each with a phase difference falling within the extension range to the total number of frequencies included in the frequency band in which the first and second frequency signals are calculated, in accordance with the following equation.

$$r_n = m_n \times 2/l \quad (4)$$

where $r_n$ (n=1, 2, . . . , N; N represents the number of extension ranges) represents the presence ratio for the n-th extension range counted from the one closest to the phase difference at the center of the reference range; $m_n$ represents the number of frequencies each with a phase difference falling within the n-th extension range; l represents the number of sampling points included in each frame (for example, 512 or 1024). The presence-ratio calculation unit 13 notifies the non-suppression range setting unit 14 of the presence ratio for each extension range.

The non-suppression range setting unit 14 sets a suppression range corresponding to a range of the phase difference for attenuating the first and second frequency signals each having a phase difference falling within the range, and a non-suppression range corresponding to a range of the phase difference not for attenuating the first and second frequency signals each having a phase difference falling within the range, on a frame-by-frame basis on the basis of the presence ratios of the respective extension ranges.

In this embodiment, when the presence ratio of the n-th extension range counted from the one closest to the phase difference at the center of the reference range (first extension range) is higher than a predetermined value, the non-suppression range setting unit 14 sets the first to (n−1)-th extension ranges (second extension range) and the n-th extension range in addition to the reference range, to be included in the non-suppression range. On the other hand, the non-suppression range setting unit 14 sets the range outside the non-suppression range to be included in the suppression range. Specifically, the suppression range includes the (n+1)-th to N-th extension ranges counted from the one closest to the phase difference at the center of the reference range (third extension range). The predetermined value is set at the lower limit of the presence ratio among those calculated when the target sound source is estimated to be located in the direction corresponding to any of the reference range and the first to n-th extension ranges, for example, 0.5.

Figure 5:
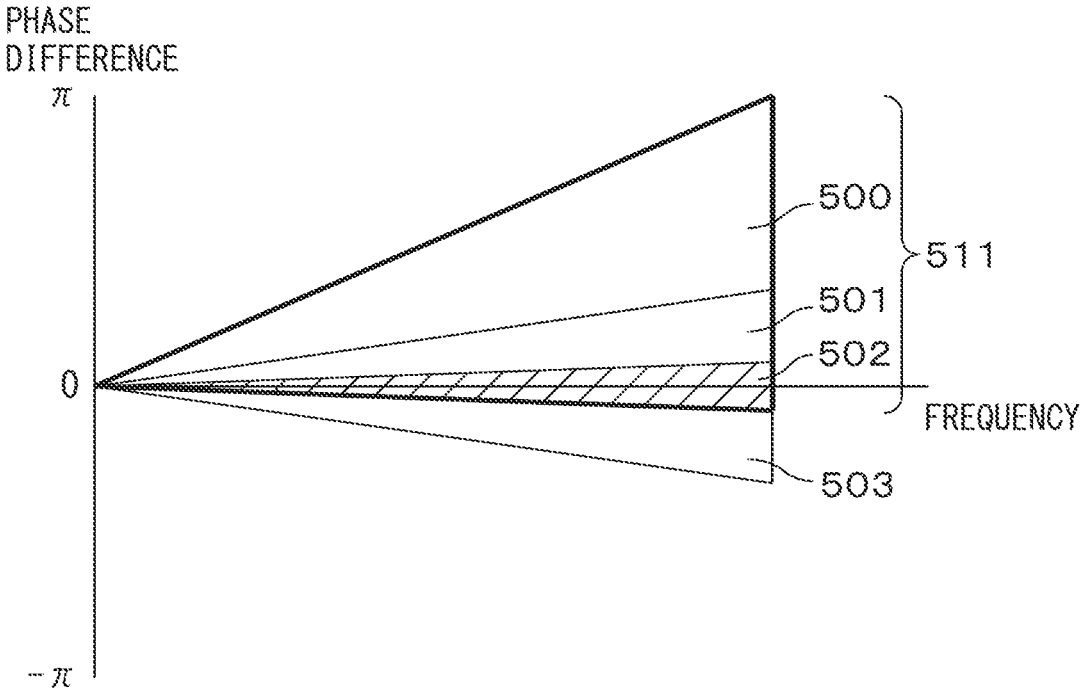
FIG. 5 is a graph illustrating one example of a non-suppression range and a suppression range.

FIG. 5 illustrates an example of the non-suppression range and the suppression range. In FIG. 5, the abscissa represents the frequency, and the ordinate represents the phase difference. In this example, three extension ranges 501 to 503 are set in this order, the extension range 501 set closest to a reference range 500. It is assumed that the presence ratio of the extension range 502 is higher than the predetermined value. Hence, the reference range 500, the extension range 502, and the extension range 501 are included in the non-suppression range 511, and the other range is included in the suppression range.

The predetermined value may be set for each extension range. In view of the definition of the reference range, the direction corresponding to a phase difference which is closer to the reference range has a higher probability that the target sound source is located in the direction. Accordingly, a higher predetermined value may be set, for example, for an extension range farther from the reference range. For example, the predetermined value for the extension range adjacent to the reference range may be set at 0.5, and the predetermined value for the other extension ranges may be set so that the predetermined value would increase by 0.05 or 0.1 for every extension range located between the reference range and the target extension range. This reduces the possibility that the direction from which noise arrives is mistakenly recognized as the direction from which the target sound arrives, consequently preventing the non-suppression range from being set too large, to thereby prevent insufficient suppression of the noise.

In a modified example, when the total of the presence ratios of the first to n-th extension ranges counted from the one closest to the phase difference at the center of the reference range is larger than the predetermined value, the non-suppression range setting unit 14 may include all the first to n-th extension ranges together with the reference range in the non-suppression range. In this way, even when the phase differences between the first voice signal and the second voice signal estimated for the respective frequencies vary widely, the non-suppression range setting unit 14 can set the non-suppression range appropriately. It is preferable, also in this case, that a higher predetermined value be set for an extension range farther from the phase difference at the center of the reference range, to prevent the non-suppression range from being set too large, to thereby prevent insufficient suppression of noise.

The non-suppression range setting unit 14 notifies the suppression coefficient calculation unit 15 of the suppression range and the non-suppression range.

The suppression coefficient calculation unit 15 calculates on a frame-by-frame basis a suppression coefficient for not attenuating the frequency components each having a phase difference falling within the non-suppression range while attenuating the frequency components each having a phase difference falling within the suppression range, among the frequency components of the first and second frequency signals. The suppression coefficient calculation unit 15, for example, sets a suppression coefficient $G(f, \Delta\theta_f)$ in a frequency f as follows.

$G(f,\Delta\theta_f)=1$ (when $\Delta\theta_f$ falls within the non-suppression range)

$G(f,\Delta\theta_f)=0$ (when $\Delta\theta_f$ falls within the suppression range)

In this example, the first and second frequency signals are not attenuated when the suppression coefficient $G(f,\Delta\theta_f)$ is set at 1, while being attenuated at a greater extent as the suppression coefficient $G(f,\Delta\theta_f)$ becomes smaller.

Alternatively, the suppression coefficient calculation unit 15 may monotonously decrease the suppression coefficient $G(f,\Delta\theta_f)$ for the frequency components each having a phase difference falling outside the non-suppression range, as the absolute value of the difference between the phase difference and one of the upper limit and the lower limit of the non-suppression range becomes larger.

Figure 6:
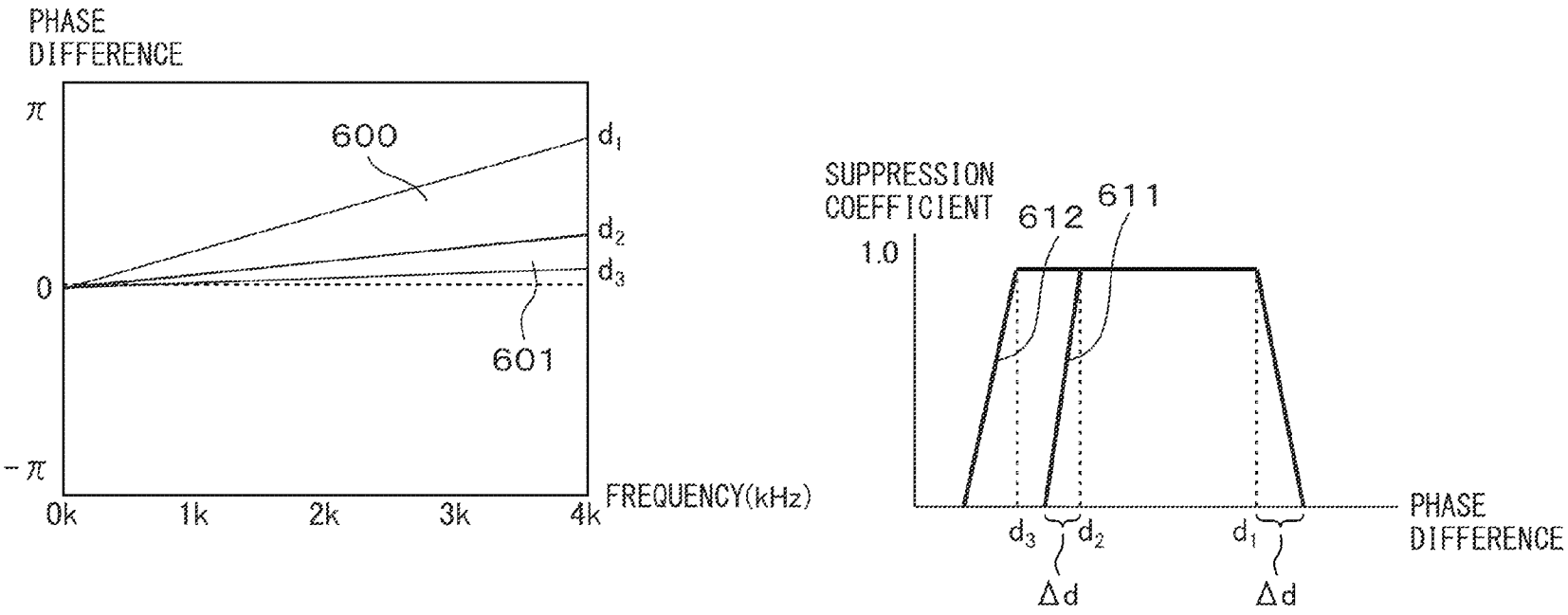
FIG. 6 is graphs illustrating one example of the relationship between a suppression coefficient and each of the suppression range and the non-suppression range.

FIG. 6 is graphs illustrating an example of the relationship between the suppression coefficient and each of the suppression range and the non-suppression range. The graph on the left in FIG. 6 presents a reference range, an extension range, and a non-suppression range set with respect to the reference range and the extension range, and the graph on the right in FIG. 6 presents the suppression coefficient at a frequency of 4 kHz. In the graph on the left in FIG. 6, the abscissa represents the frequency, and the ordinate represents the phase difference. In the graph on the right in FIG. 6, the abscissa represents the phase difference, and the ordinate represents the suppression coefficient.

Assuming that only a reference range 600 is included in the non-suppression range, i.e., the range between phase differences d1 and d2 is included in the non-suppression range at a frequency of 4 kHz. In this case, as represented by a polygonal line 611, the suppression coefficient is fixed at 1 in the range between the phase differences d1 and d2, and monotonously decreases as the phase difference becomes larger than the phase difference d1 or smaller than the phase difference d2. When the phase difference becomes the difference Δd larger than the phase difference d1 or the difference Δd smaller than the phase difference d2, the suppression coefficient is fixed at 0.

By contrast, assuming that an extension range 601 is also included in the non-suppression range together with the reference range 600, i.e., the range between the phase differences d1 and d3 is included in the non-suppression range at a frequency of 4 kHz. In this case, as represented by a polygonal line 612, the suppression coefficient is fixed at 1 in the range between the phase differences d1 and d3, and monotonously decreases as the phase difference becomes larger than the phase difference d1 or smaller than the phase difference d3.

Note that the method of calculating the suppression coefficients is not limited to the above example. The suppression coefficients only need to be calculated so that the frequency components each having a phase difference falling within the suppression range would be attenuated at a greater extent than that for the frequency components each having a phase difference falling within the non-suppression range.

The suppression coefficient calculation unit 15 passes the suppression coefficient $G(f,\Delta\theta_f)$ calculated for each frequency to the signal correction unit 16.

The signal correction unit 16 corrects the first and second frequency signals, for example, in accordance with the following equation, based on the phase difference $\Delta\theta_f$ between the first and second frequency signals and the suppression coefficients $G(f,\Delta\theta_f)$ received from the suppression coefficient calculation unit 15, on a frame-by-frame basis.

$$Y(f)=G(f,\Delta\theta_f)\cdot X(f) \tag{5}$$

where X(f) represents the amplitude component of the first or second frequency signal, and Y(f) represents the corrected amplitude component of the first or second frequency signal. Further, f represents the frequency band. As can be seen from the equation (5), Y(f) decreases as the suppression coefficient $G(f,\Delta\theta_f)$ becomes smaller. This means that the frequency components of the respective first and second frequency signals at a frequency with the phase difference $\Delta\theta_f$ falling outside the non-suppression range are attenuated by the signal correction unit 16. On the other hand, the frequency components of the respective first and second frequency signals at a frequency with the phase difference $\Delta\theta_f$ falling within the non-suppression range are not attenuated by the signal correction unit 16. The equation for correction is not limited to the above equation (5), but the signal correction unit 16 may correct the first and second frequency signals by using some other suitable function for attenuating the components of the first and second frequency signals whose phase difference is outside the non-suppression range. The signal correction unit 16 passes the corrected first and second frequency signals to the frequency-time transforming unit 17.

The frequency-time transforming unit 17 transforms the corrected first and second frequency signals into time-domain signals by reversing the time-frequency transformation performed by the time-frequency transforming unit 11, and thereby produces the corrected first and second voice signals. With the corrected first and second voice signals, the target sound is easier to hear by attenuating noise and any sound arriving from a direction other than the direction in which the target sound source is located.

Figure 7:
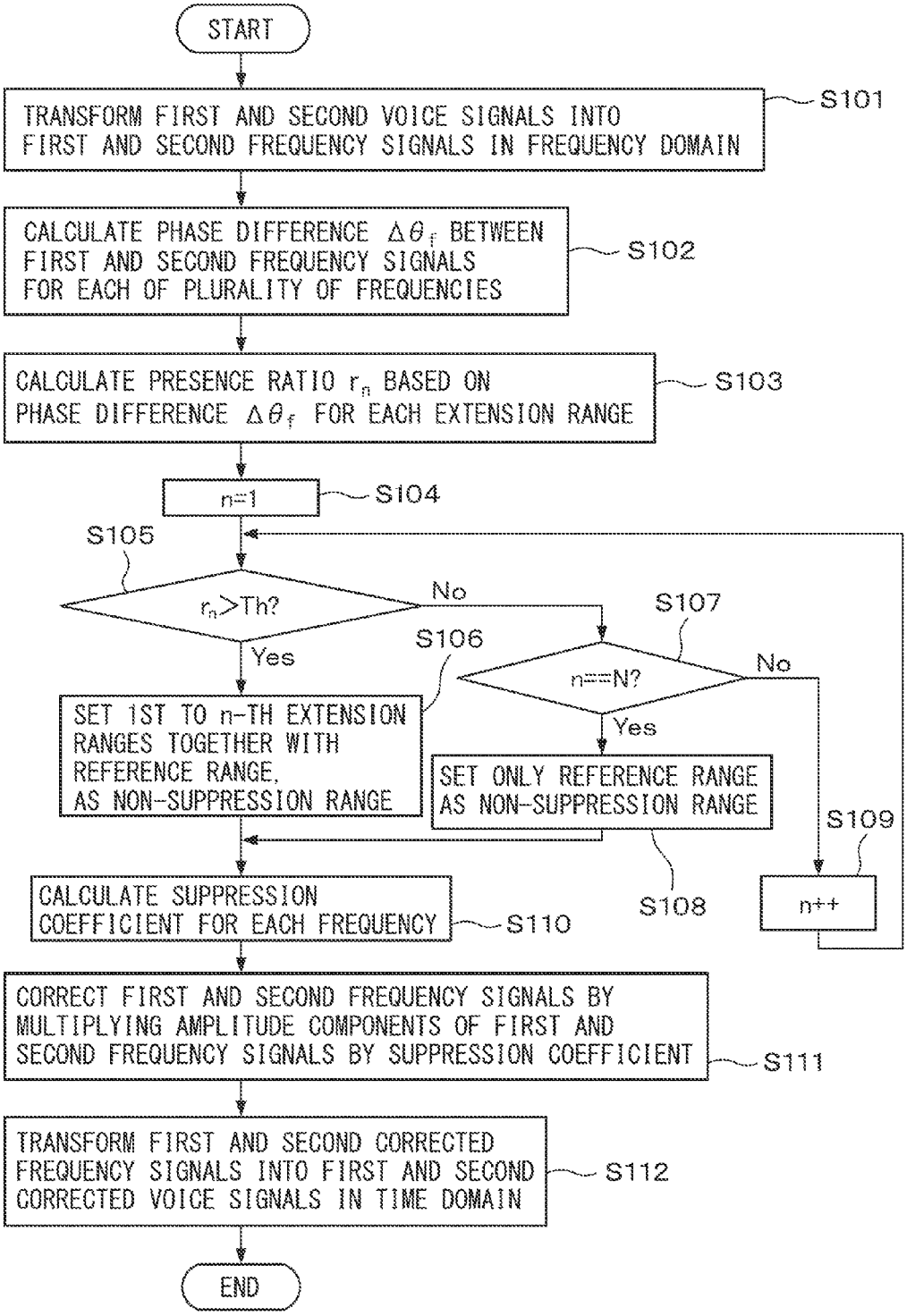
FIG. 7 is an operational flowchart of voice processing.

FIG. 7 is an operational flowchart of the voice processing performed by the processing unit 6. The processing unit 6 performs the following process on a frame-by-frame basis.

The time-frequency transforming unit 11 transforms the first and second voice signals into the first and second frequency signals in the frequency domain (step S101). Then, the time-frequency transforming unit 11 passes the first and second frequency signals to the phase difference calculation unit 12 and the signal correction unit 16.

The phase difference calculation unit 12 calculates the phase difference $\Delta\theta_f$ between the first frequency signal and the second frequency signal for each of the plurality of frequencies (step S102). Then, the phase difference calculation unit 12 passes the phase difference $\Delta\theta_f$ calculated for each frequency to the presence-ratio calculation unit 13 and the signal correction unit 16.

The presence-ratio calculation unit 13 calculates a presence ratio $r_n$ for each extension range (step S103). Then, the presence-ratio calculation unit 13 notifies the non-suppression range setting unit 14 of the presence ratio $r_n$ calculated for each extension range.

The non-suppression range setting unit 14 sets, as a target extension range, the first extension range counted from the one closest to the phase difference at the center of the reference range (n=1) (step S104). Then, the non-suppression range setting unit 14 determines whether or not the presence ratio $r_n$ of the target extension range is higher than a predetermined value Th (step S105). When the presence ratio $r_n$ of the target extension range is higher than the predetermined value Th (Yes in step S105), the non-suppression range setting unit 14 sets, as the non-suppression range, the first to n-th extension ranges counted from the one closest to the phase difference at the center of the reference range together with the reference range (step S106).

On the other hand, when the presence ratio $r_n$ of the target extension range is lower than or equal to the predetermined value Th (No in step S105), the non-suppression range setting unit 14 determines whether or not the target extension range is the N-th extension range, which is farthest from the phase difference at the center of the reference range (step S107). When the target extension range is the N-th extension range (i.e., n==N) (Yes in step S107), the non-suppression range setting unit 14 sets only the reference range as the non-suppression range (step S108).

On the other hand, when the target extension range is not the N-th extension range (No in step S107), the non-suppression range setting unit 14 sets, as the next target extension range, the (n+1)-th extension range counted from the one closest to the phase difference at the center of the reference range (step S109). Then, the non-suppression range setting unit 14 repeats the processing in step S105 and thereafter.

After step S106 or S108, the suppression coefficient calculation unit 15 calculates, for each frequency, a suppression coefficient for attenuating the first and second frequency signals having a phase difference falling within the suppression range without attenuating the first and second frequency signals having a phase difference falling within the non-suppression range (step S110). Then, the suppression coefficient calculation unit 15 passes the suppression frequency calculated for each frequency to the signal correction unit 16.

The signal correction unit 16 corrects, for each frequency, the first and second frequency signals by multiplying the amplitudes of the first and second frequency signals with the suppression coefficient calculated for the frequency (step S111). Then, the signal correction unit 16 passes the corrected first and second frequency signals to the frequency-time transforming unit 17.

The frequency-time transforming unit 17 transforms the corrected first and second frequency signals into corrected first and second voice signals in the time domain (step S112). The processing unit 6 outputs the corrected first and second voice signals, and then terminates the voice processing.

In the above processing, the order of step S103 and step S104 may be switched. In this case, every time a new target extension range is set, the presence ratio for the target extension range may be calculated, instead of calculating the presence ratio for each of all the extension ranges at first.

As has been described above, the voice processing apparatus includes, in the non-suppression range, extension ranges including many phase differences of the first voice signal and the second voice signal for each frequency. In this way, even when the SNR of the first and second voice signals is low, the voice processing apparatus can attenuate noise while reducing the possibility of the target sound being attenuated, which prevents the target sound from being distorted.

In a modified example, the reference range may be set in advance to cover a large range, for example, to correspond to the entire range of the directions from which the target sound is assumed to arrive, and one or more extension ranges may be set within the reference range. In this case, the non-suppression range setting unit 14 determines, for each of the extension ranges in order from the one closest to an edge of the reference range, whether or not the presence ratio is higher than the predetermined value, for example. Then, the non-suppression range setting unit 14 sets, as the non-suppression range, the reference range excluding the extension range located closer to an edge of the reference range than the extension range having the presence ratio determined to be higher than the predetermined value first (first extension range) is (third extension range).

Figure 8A:
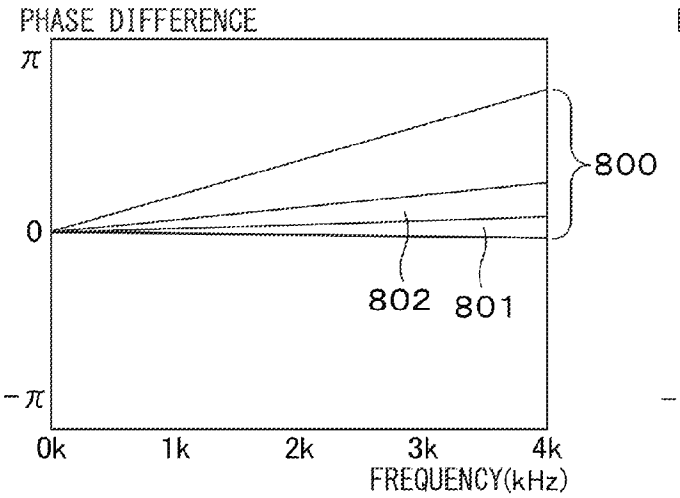
FIG. 8A is a graph illustrating one example of a reference range and extension ranges according to a modified example.

FIG. 8A is a graph illustrating an example of the reference range and the extension ranges according to this modified example. In FIG. 8A, the abscissa represents the frequency, and the ordinate represents the phase difference. In this example, two extension ranges 801 and 802 are set in a reference range 800. The extension range 801 is set so that one edge of the extension range 801 would be in contact with one edge of the reference range 800, the one edge representing the smallest phase difference in the reference range 800, while the extension range 802 is set at a position closer to the phase difference at the center of the reference range 800 than the extension range 801 is so that one edge of the extension range 802 would be in contact with the other edge of the extension range 801. It is preferable also in this example that each extension range be set smaller as the phase difference becomes closer to 0.

Figure 8B:
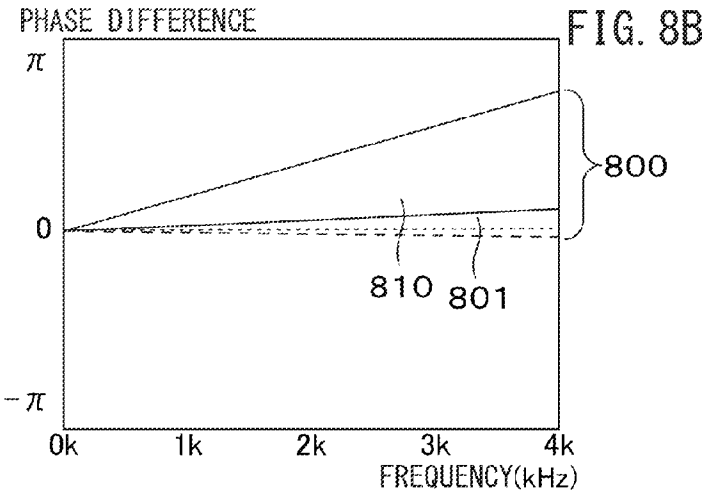
FIG. 8B is a graph illustrating one example of a non-suppression range set with respect to the reference range and the extension ranges illustrated in FIG. 8A.
Figure 8C:
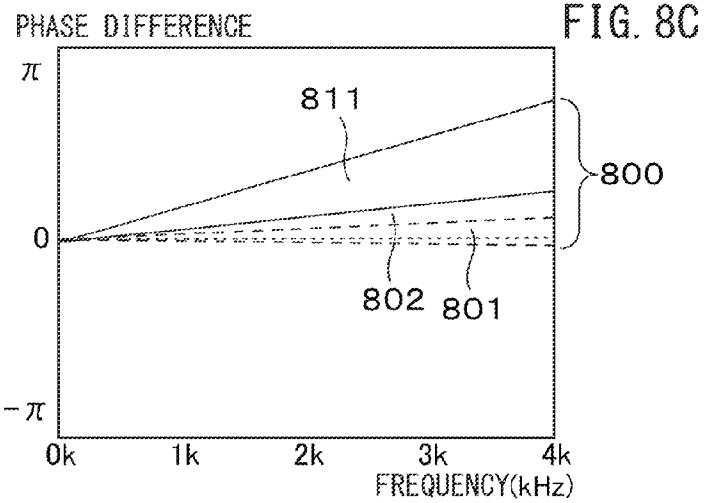
FIG. 8C is a graph illustrating another example of the non-suppression range set with respect to the reference range and the extension ranges illustrated in FIG. 8A.

FIG. 8B and FIG. 8C are each a graph illustrating an example of the non-suppression range set with respect to the reference range and the extension ranges presented in FIG. 8A. In each of FIG. 8B and FIG. 8C, the abscissa represents the frequency, and the ordinate represents the phase difference. When the presence ratio of the extension range 801 is lower than or equal to the predetermined value and the presence ratio of the extension range 802 is higher than the predetermined value, the non-suppression range setting unit 14 sets, as a non-suppression range 810, the range obtained by excluding the extension range 801 from the reference range 800, as presented in FIG. 8B. On the other hand, when the presence ratios of both the extension range 801 and the extension range 802 are lower than or equal to the predetermined value, the non-suppression range setting unit 14 sets, as a non-suppression range 811, the range obtained by excluding the extension ranges 801 and 802 from the reference range 800, as presented in FIG. 8C.

Figure 9:
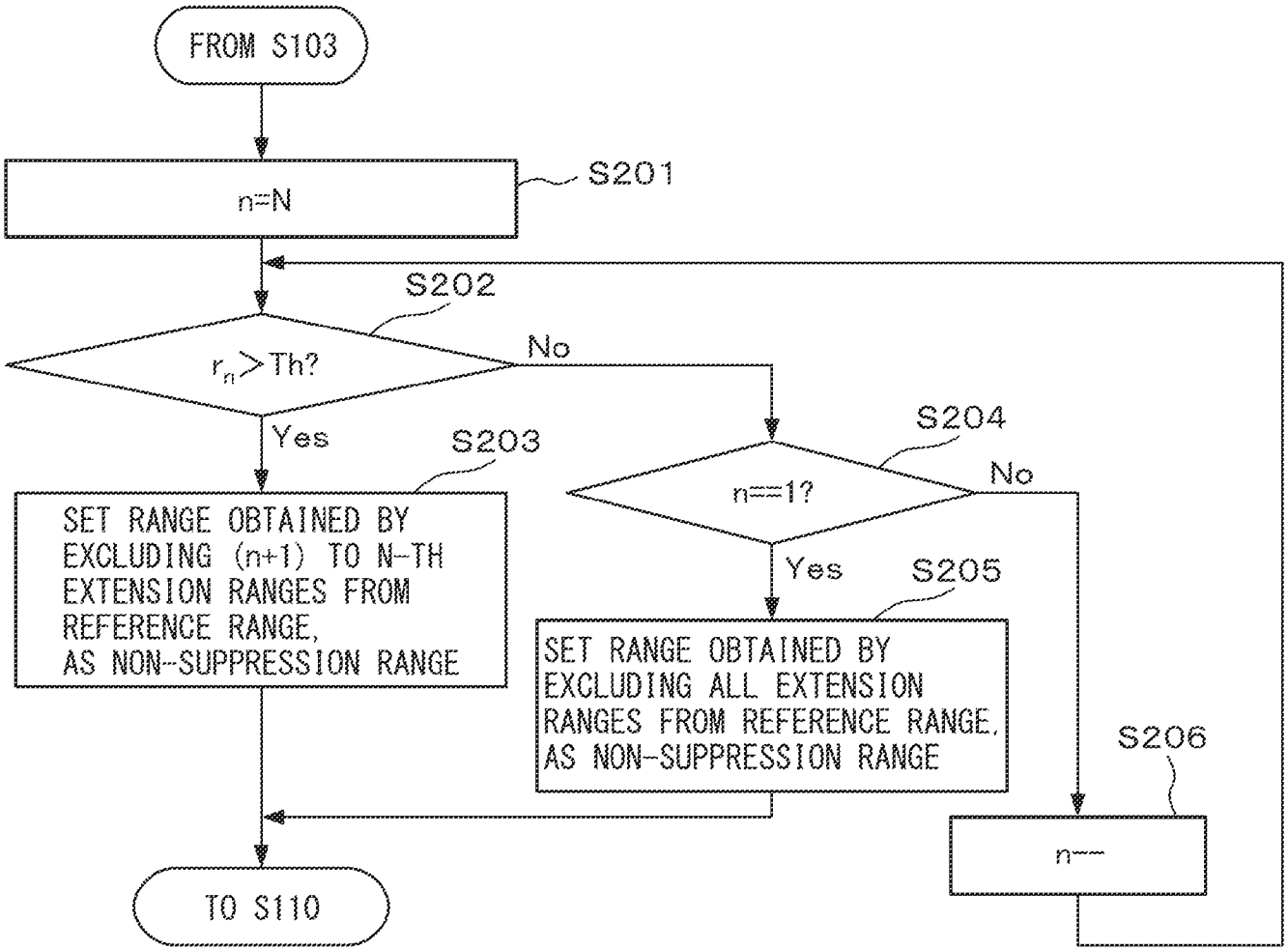
FIG. 9 is an operational flowchart related to setting of the non-suppression range according to the modified example.

FIG. 9 is an operational flowchart related to setting of the non-suppression range by the non-suppression range setting unit 14 according to the modified example. Instead of steps S104 to S109 in the operational flowchart presented in FIG. 7, the non-suppression range setting unit 14 sets the non-suppression range and suppression range in accordance with the operational flowchart to be described below.

The non-suppression range setting unit 14 sets, as a target extension range, the extension range which is adjacent to one edge of the reference range and is located farthest from the phase difference at the center of the reference range (i.e., n=N) (step S201). Then, the non-suppression range setting unit 14 determines whether or not the presence ratio $r_n$ of the target extension range is higher than the predetermined value Th (step S202). When the presence ratio $r_n$ of the target extension range is higher than the predetermined value Th (Yes in step S202), the non-suppression range setting unit 14 sets, as the non-suppression range, the range obtained by excluding, from the reference range, the (n+1)-th to N-th extension ranges closer to an edge of the reference range than the target extension range is (step S203).

On the other hand, when the presence ratio $r_n$ of the target extension range is lower than or equal to the predetermined value Th (No in step S202), the non-suppression range setting unit 14 determines whether or not the target extension range is the extension range closest to the phase difference at the center of the reference range (step S204). When the target extension range is the extension range closest to the phase difference at the center of the reference range (i.e., n==1) (Yes in step S204), the non-suppression range setting unit 14 sets, as the non-suppression range, the range obtained by excluding all the extension ranges from the reference range (step S205).

On the other hand, when the target extension range is not the extension range closest to the phase difference at the center of the reference range (No in step S204), the non-suppression range setting unit 14 sets, as the next target extension range, the (n−1)-th extension range counted from the one closest to the phase difference at the center of the reference range (step S206). Then, the non-suppression range setting unit 14 repeats the processing in step S202 and thereafter. Moreover, the processing in step S110 and thereafter is performed after step S203 or S205.

Next, a voice processing apparatus according to a second embodiment will be described. The voice processing apparatus of the second embodiment changes a method to be used for calculating a suppression coefficient, depending on whether or not the presence ratio of each of all extension ranges is lower than or equal to the predetermined value.

The voice processing apparatus of the second embodiment differs from the voice processing apparatus of the first embodiment in the processing performed by the suppression coefficient calculation unit 15. The following description therefore deals with the suppression coefficient calculation unit 15 and related units. For the other component elements of the voice processing apparatus of the second embodiment, refer to the description earlier given of the corresponding component elements of the voice processing apparatus of the first embodiment.

When the presence ratio of at least any one of the extension ranges is higher than the predetermined value, the suppression coefficient calculation unit 15 calculates a suppression coefficient on the basis of the phase difference between the first frequency signal and the second frequency signal as in the first embodiment. On the other hand, when the presence ratio of each of all the extension ranges is lower than or equal to the predetermined value, the suppression coefficient calculation unit 15 calculates a first suppression coefficient candidate based on the phase difference, and a second suppression coefficient candidate based on an index other than the phase difference, the index representing the likelihood of noise. In the same way for the suppression coefficient in the above embodiment, the suppression coefficient calculation unit 15 calculates the first suppression coefficient candidate so that the frequencies each with a phase difference falling within the suppression range would be attenuated at a greater extent than that for the frequencies each with a phase difference falling within the non-suppression range. It is preferable that the minimum value of the first suppression coefficient candidate be set at a value larger than 0, for example, 0.1 to 0.5. In addition, it is preferable that the suppression coefficient calculation unit 15 set the value of the second suppression coefficient candidate to be smaller as the index representing the likelihood of noise indicates a higher probability that the first and second frequency signals originate in a noise. Then, the suppression coefficient calculation unit 15 calculates, for each of all the frequencies, a suppression coefficient from the first suppression coefficient candidate and the second suppression coefficient candidate so that the suppression coefficient would be smaller than or equal to the smaller one of the first suppression coefficient candidate and the second suppression coefficient candidate.

As the index representing the likelihood of noise, for example, the ratio between the amplitude of the first frequency signal and the amplitude of the second frequency signal is used. For example, when the first voice input unit 2-1 is assumed to be closer to the target sound source than the second voice input unit 2-2 is, the amplitude ratio R(f) is calculated in accordance with the following equation.

$$R(f) = \frac{A_2(f)}{A_1(f)} \tag{6}$$

where $A_1(f)$ represents the component of the first frequency signal with a frequency f, and $A_2(f)$ represents the component of the second frequency signal with the same frequency f.

Generally, the closer a microphone is located to the sound source, the larger the sound component from the sound source included in a voice signal becomes. Accordingly, it is estimated that a smaller amplitude ratio R(f) indicates that the sound source of the frequency component is closer to the first voice input unit 2-1, and a larger amplitude ratio R(f) indicates that the sound source of the frequency component is closer to the second voice input unit 2-2. It is therefore estimated that the larger the amplitude ratio R(f) at the frequency f is, the higher the possibility that the components of the first and second frequency signals with the frequency f are noise components becomes. Accordingly, the suppression coefficient calculation unit 15 sets the second suppression coefficient candidate so that the first and second frequency signals would be attenuated when the amplitude ratio R(f) is larger than a predetermined threshold value which is smaller than 1 (e.g., 0.6 to 0.8), while the first and second frequency signals would not be attenuated when the amplitude ratio R(f) is smaller than or equal to the predetermined threshold value.

Figure 10:
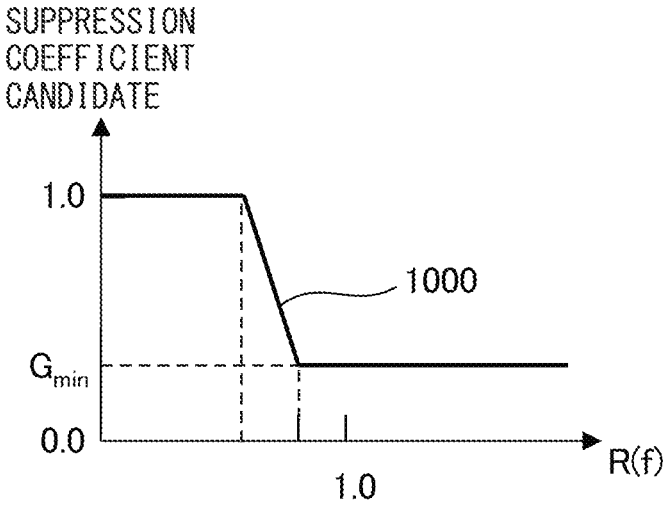
FIG. 10 is a graph illustrating one example of the relationship between an amplitude ratio and a second suppression coefficient.

FIG. 10 is a graph illustrating an example of the relationship between the amplitude ratio and the second suppression coefficient candidate. In FIG. 10, the abscissa represents the amplitude ratio R(f), and the ordinate represents the second suppression coefficient candidate. In addition, a polygonal line 1000 represents the relationship between the amplitude ratio R(f) and the second suppression coefficient candidate. When the amplitude ratio R(f) is lower than or equal to the threshold value Th, the second suppression coefficient candidate is set at 1, i.e., a value which does not attenuate the first and second frequency signals. Then, the second suppression coefficient candidate monotonously decreases as the amplitude ratio R(f) becomes higher than the threshold value Th, and is set at a fixed value Gmin when the amplitude ratio R(f) becomes higher than or equal to a second threshold value Th2. The fixed value Gmin is set at 0.1 to 0.5, for example.

As the index representing likelihood of noise, a cross-correlation value between the first voice signal and the second voice signal may be used instead of an amplitude ratio. When the first voice input unit 2-1 and the second voice input unit 2-2 both record the same target sound, the first voice signal and the second voice signal are similar. Hence, the absolute value of the cross-correlation value is large in this case. On the other hand, when the first voice input unit 2-1 and the second voice input unit 2-2 record sounds from different sound sources, the absolute value of the cross-correlation value is small. Accordingly, the suppression coefficient calculation unit 15 sets the second suppression coefficient candidate at a value which can attenuate the first and second frequency signals (e.g., 0.1 to 0.5) when the absolute value of the cross-correlation value is smaller than a predetermined threshold value (e.g., 0.5). On the other hand, when the absolute value of the cross-correlation value is larger than or equal to the predetermined threshold value, the suppression coefficient calculation unit 15 sets the second suppression coefficient candidate at a value which does not attenuate the first and second frequency signals, i.e., 1.

Alternatively, as the index representing likelihood of noise, an autocorrelation value of a voice signal generated by one of the first and second voice input units, the voice input unit assumed to be located closer to the target sound source than the other is. In the following, description will be given by assuming that the first voice input unit 2-1 is located closer to the target sound source than the second voice input unit 2-2 is.

When the target sound is a human voice, the first frequency signals in two frames which are successive in terms of time have similarity. In view of this, the suppression coefficient calculation unit 15 calculates an autocorrelation value between the first frequency signals in two frames which are successive in terms of time. Then, when the absolute value of the calculated autocorrelation value is smaller than a predetermined threshold value (e.g., 0.5), the suppression coefficient calculation unit 15 sets the second suppression coefficient candidate at a value which attenuates the first and second frequency signals (e.g., 0.1 to 0.5). On the other hand, when the absolute value of the calculated autocorrelation value is larger than or equal to the predetermined threshold value, the suppression coefficient calculation unit 15 sets the second suppression coefficient candidate at a value which does not attenuate the first and second frequency signals, i.e., 1.

Moreover, as the index representing likelihood of noise, the suppression coefficient calculation unit 15 may use the stationarity of a voice signal generated by one of the first and second voice input units, the voice input unit assumed to be located closer to the target sound source than the other is located. In the following, description will be given by assuming that the first voice input unit 2-1 is located closer to the target sound source than the second voice input unit 2-2 is located.

Generally, when a certain frequency component of the first voice signal originates in stationary noise, the amplitude of the frequency component does not change significantly with time. It is therefore assumed that, the smaller the change in the amplitude of the frequency component is the more likely the frequency component originates in stationary noise. In view of this, the suppression coefficient calculation unit 15 calculates the stationarity of the first frequency signal for each frequency, in accordance with the following equation.

$$S_f(i) = \frac{|I_f(i) - I_f(i-1)|}{I_{f,avg}} \tag{7}$$

where $I_f(i)$ represents the amplitude spectrum of the first frequency signal at a frequency f in the current frame, and $I_f(i-1)$ represents the amplitude spectrum of the first frequency signal at the same frequency f in the immediately previous frame. Moreover, $I_{f,avg}$ represents a long-term average value of the amplitude spectra of the first frequency signal at the frequency f, and may be, for example, the average value of the amplitude spectra in the last 10 to 100 frames. Furthermore, $S_f(i)$ represents the stationarity at the frequency f in the current frame.

When the value $S_f(i)$ is larger than or equal to a predetermined threshold value (e.g., 0.5), the suppression coefficient calculation unit 15 sets the second suppression coefficient candidate for the frequency f at a value which attenuates the first and second frequency signals (e.g., 0.1 to 0.5). On the other hand, when the value $S_f(i)$ is smaller than the predetermined threshold value, the suppression coefficient calculation unit 15 sets the second suppression coefficient candidate at a value which does not attenuate the first and second frequency signals, i.e., 1. The suppression coefficient calculation unit 15 may calculate, as the stationarity of the current frame, the average value S(i) of the values $S_f(i)$ of all the frequencies. Then, when the value S(i) is larger than or equal to a predetermined threshold value (e.g., 0.5), the suppression coefficient calculation unit 15 may set the second suppression coefficient candidate for each of all the frequencies at a value which attenuates the first and second frequency signals (e.g., 0.1 to 0.5). On the other hand, when the value S(i) is smaller than the predetermined threshold value, the suppression coefficient calculation unit 15 may set the second suppression coefficient candidate for each of all the frequencies at a value which does not attenuate the first and second frequency signals, i.e., 1.

When both the first suppression coefficient candidate and the second suppression coefficient candidate are calculated, the suppression coefficient calculation unit 15 sets, for each frequency, the smaller one of the first suppression coefficient candidate and the second suppression coefficient candidate as the suppression coefficient. Alternatively, the suppression coefficient calculation unit 15 may set, for each frequency, the value obtained by multiplying the first suppression coefficient candidate by the second suppression coefficient candidate, as the suppression coefficient. The suppression coefficient calculation unit 15 supplies the obtained suppression coefficient to the signal correction unit 16, for each frequency.

According to this embodiment, since the voice processing apparatus calculates a suppression coefficient on the basis of a plurality of indices, the voice processing apparatus can set a more appropriate suppression coefficient even when the phase differences calculated for the respective frequencies are not concentrated in a particular extension range and therefore identification of a sound source direction is difficult.

Moreover, the voice processing apparatus according to each of the above embodiments and modified examples may correct only one of the first and second voice signals. In this case, in each of the above embodiments and modified examples, the suppression coefficient may be calculated only for the one of the first and second frequency signals which is the correction target. Then, the signal correction unit 16 may correct only the correction-target frequency signal, and the frequency-time transforming unit 17 may transform only the correction-target frequency signal into a time-domain signal.

Further, a computer program for causing a computer to implement the various functions of the processing unit of the voice processing apparatus according to each of the above embodiments and modified examples may be provided in the form recorded on a computer readable medium such as a magnetic recording medium or an optical recording medium.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present inventions have been described in detail, it should be understood that the various changes, substitutions, and alternations could be made hereto without departing from the spirit and scope of the invention.

What is claimed is:

1. A voice processing apparatus comprising:

a first microphone configured to generate a first voice signal representing a recorded voice;

a second microphone being provided at a position different from a position of the first microphone, and configured to generate a second voice signal representing a recorded voice;

a memory configured to store a reference range representing a range of a phase difference between the first voice signal and the second voice signal for each frequency and corresponding to a direction in which a target sound source to be recorded is assumed to be located, and at least one extension range representing a range of a phase difference between the first voice signal and the second voice signal for each frequency and set outside or inside the reference range so as to align in order from one edge of the reference range; and a processor configured to:

transform the first voice signal and the second voice signal respectively into a first frequency signal and a second frequency signal in a frequency domain, on a frame-by-frame basis with each frame having a predetermined time length;

calculate a phase difference between the first frequency signal and the second frequency signal for each of a plurality of frequencies on the frame-by-frame basis;

count, for each of the at least one extension range, a number of frequencies each with the phase difference between the first frequency signal and the second frequency signal falling within the extension range, on the frame-by-frame basis;

calculate, for each of the at least one extension range, a presence ratio being a ratio of the number of frequencies to total number of frequencies included in a frequency band in which the first frequency signal and the second frequency signal are calculated, on the frame-by-frame basis;

set, as a non-suppression range, a first extension range having the presence ratio higher than a predetermined value and a second extension range closer to the phase difference at center of the reference range than the first extension range among the at least one extension range, and a range not including a third extension range farther from the phase difference at the center of the reference range than the first extension range in the reference range, on the frame-by-frame basis;

set, as a suppression range, a range of the phase difference outside the non-suppression range, on the frame-by-frame basis;

calculate, for at least one of the first and second frequency signals, a suppression coefficient for attenuating a frequency component having the phase difference between the first frequency signal and the second frequency signal falling within the suppression range, at a greater extent than attenuation for a frequency component having the phase difference between the first frequency signal and the second frequency signal falling within the non-suppression range, on the frame-by-frame basis;

correct the at least one of the first and second frequency signals by multiplying amplitude of the component of the at least one of the first and second frequency signals at each frequency by the suppression coefficient for the frequency, on the frame-by-frame basis; and transform the at least one of the first and second frequency signals corrected, into a corrected voice signal in a time domain, wherein the predetermined value, for each extension range, is set to be higher as the extension range is located farther from the phase difference at the center of the reference range.

2. The voice processing apparatus according to claim 1, wherein difference between the phase differences in each of the at least one extension range is set to be smaller as the phase differences in the extension range are closer to 0.

3. The voice processing apparatus according to claim 1, wherein, when the presence ratio of each of the at least one extension range is lower than or equal to the predetermined value, calculation of the suppression coefficient:

calculates, with respect to the at least one of the first and second frequency signals, a first suppression coefficient candidate for attenuating a component at each frequency with the phase difference between the first frequency signal and the second frequency signal falling within the suppression range, at a greater extent than attenuation for a component at the frequency with the phase difference between the first frequency signal and the second frequency signal falling within the non-suppression range, and a second suppression coefficient candidate for attenuating the at least one of the first frequency signal and the second frequency signal at a greater extent as it is more likely that the first and second frequency signals are noise, and calculates the suppression coefficient so that the suppression coefficient would be smaller than or equal to a smaller one of the first suppression coefficient candidate and the second suppression coefficient candidate in the entire frequency band.

4. The voice processing apparatus according to claim 1, wherein, when total of the presence ratios of a first extension range to an extension range at a predetermined position in order counted from one closest to the phase difference at the center of the reference range is higher than the predetermined value for the extension range at the predetermined position, setting the non-suppression range sets, as the non-suppression range, the first extension range to the extension range at the predetermined position and a range not including an extension range farther from the phase difference at the center of the reference range than the extension range at the predetermined position is, in the reference range, on a frame-by-frame basis.

5. The voice processing apparatus according to claim 1, wherein the suppression coefficient is constant for the frequency component having the phase difference between the first frequency signal and the second frequency signal falling within the non-suppression range.

6. A voice processing method comprising:

generating a first voice signal representing a recorded voice by a first microphone;

generating a second voice signal representing a recorded voice by a second microphone which is provided at a position different from a position of the first microphone;

transforming the first voice signal and the second voice signal respectively into a first frequency signal and a second frequency signal in a frequency domain, on a frame-by-frame basis with each frame having a predetermined time length;

calculating a phase difference between the first frequency signal and the second frequency signal for each of a plurality of frequencies on the frame-by-frame basis;

counting, for each of at least one extension range, a number of frequencies each with the phase difference between the first frequency signal and the second frequency signal falling within the extension range, on the frame-by-frame basis, the at least one extension range representing a range of the phase difference between the first voice signal and the second voice signal for each frequency and set outside or inside a reference range so as to align in order from one edge of the reference range, the reference range representing a range of the phase difference between the first voice signal and the second voice signal for each frequency and corresponding to a direction in which a target sound source to be recorded is assumed to be located;

calculating, for each of the at least one extension range, a presence ratio being a ratio of the number of frequencies to total number of frequencies included in a frequency band in which the first frequency signal and the second frequency signal are calculated, on the frame-by-frame basis;

setting, as a non-suppression range, a first extension range having the presence ratio higher than a predetermined value and a second extension range closer to the phase difference at center of the reference range than the first extension range among the at least one extension range, and a range not including a third extension range farther from the phase difference at the center of the reference range than the first extension range in the reference range, on the frame-by-frame basis;

setting, as a suppression range, a range of the phase difference outside the non-suppression range, on the frame-by-frame basis;

calculating, for at least one of the first frequency signal and the second frequency signal, a suppression coefficient for attenuating a frequency component having the phase difference between the first frequency signal and the second frequency signal falling within the suppression range, at a greater extent than attenuation for a frequency component having the phase difference between the first frequency signal and the second frequency signal falling within the non-suppression range, on the frame-by-frame basis;

correcting the at least one of the first and second frequency signals by multiplying amplitude of the component of the at least one of the first and second frequency signals at each frequency by the suppression coefficient for the frequency, on the frame-by-frame basis; and transforming the at least one of the first and second frequency signals corrected, into a corrected voice signal in a time domain; and outputting, by an output device, the corrected voice signal to an another apparatus, wherein the predetermined value, for each extension range, is set to be higher as the extension range is located farther from the phase difference at the center of the reference range.

7. The voice processing method according to claim 6, wherein difference between the phase differences in each of the at least one extension range is set to be smaller as the phase differences in the extension range are closer to 0.

8. The voice processing method according to claim 6, wherein, when the presence ratio of each of the at least one extension range is lower than or equal to the predetermined value, the calculating the suppression coefficient:

calculates, with respect to the at least one of the first and second frequency signals, a first suppression coefficient candidate for attenuating a component at each frequency with the phase difference between the first frequency signal and the second frequency signal falling within the suppression range, at a greater extent than attenuation for a component at the frequency with the phase difference between the first frequency signal and the second frequency signal falling within the non-suppression range, and a second suppression coefficient candidate for attenuating the at least one of the first frequency signal and the second frequency signal at a greater extent as it is more likely that the first and second frequency signals are noise, and calculates the suppression coefficient so that the suppression coefficient would be smaller than or equal to a smaller one of the first suppression coefficient candidate and the second suppression coefficient candidate in the entire frequency band.

9. The voice processing method according to claim 6, wherein, when total of the presence ratios of a first extension range to an extension range at a predetermined position in order counted from one closest to the phase difference at the center of the reference range is higher than the predetermined value for the extension range at the predetermined position, the setting the non-suppression range sets, as the non-suppression range, the first extension range to the extension range at the predetermined position and a range not including an extension range farther from the phase difference at the center of the reference range than the extension range at the predetermined position is, in the reference range, on a frame-by-frame basis.

10. A non-transitory computer-readable recording medium having recorded thereon a voice processing computer program that causes a computer to execute a process comprising:

transforming a first voice signal and a second voice signal respectively into a first frequency signal and a second frequency signal in a frequency domain, on a frame-by-frame basis with each frame having a predetermined time length, the first voice signal representing a recorded voice generated by a first microphone, the second voice signal representing a recorded voice generated by a second microphone which is provided at a position different from a position of the first microphone;

calculating a phase difference between the first frequency signal and the second frequency signal for each of a plurality of frequencies on the frame-by-frame basis;

counting, for each of at least one extension range, a number of frequencies each with the phase difference between the first frequency signal and the second frequency signal falling within the extension range, on the frame-by-frame basis, the at least one extension range representing a range of the phase difference between the first voice signal and the second voice signal for each frequency and set outside or inside a reference range so as to align in order from one edge of the reference range, the reference range representing a range of the phase difference between the first voice signal and the second voice signal for each frequency and corresponding to a direction in which a target sound source to be recorded is assumed to be located;

calculating, for each of the at least one extension range, a presence ratio being a ratio of the number of frequencies to total number of frequencies included in a frequency band in which the first frequency signal and the second frequency signal are calculated, on the frame-by-frame basis;

setting, as a non-suppression range, a first extension range having the presence ratio higher than a predetermined value and a second extension range closer to the phase difference at center of the reference range than the first extension range among the at least one extension range, and a range not including a third extension range farther from the phase difference at the center of the reference range than the first extension range in the reference range, on the frame-by-frame basis;

setting, as a suppression range, a range of the phase difference outside the non-suppression range, on the frame-by-frame basis;

calculating, for at least one of the first frequency signal and the second frequency signal, a suppression coefficient for attenuating a frequency component having the phase difference between the first frequency signal and the second frequency signal falling within the suppression range, at a greater extent than attenuation for a frequency component having the phase difference between the first frequency signal and the second frequency signal falling within the non-suppression range, on the frame-by-frame basis;

correcting the at least one of the first and second frequency signals by multiplying amplitude of the component of the at least one of the first and second frequency signals at each frequency by the suppression coefficient for the frequency, on the frame-by-frame basis; and transforming the at least one of the first and second frequency signals corrected, into a corrected voice signal in a time domain; and outputting the corrected voice signal to an another apparatus, wherein the predetermined value, for each extension range, is set to be higher as the extension range is located farther from the phase difference at the center of the reference range.

* * * * *